US005859777A

United States Patent [19]

Yokoyama et al.

[11] Patent Number: 5,859,777

[45] Date of Patent: Jan. 12, 1999

[54] CASTING CONTROL SUPPORT SYSTEM FOR DIE CASTING MACHINES

[75] Inventors: Hiroshi Yokoyama; Yukio Mizota, both of Shizuoka-ken, Japan

[73] Assignee: Toshiba Kikai Kabushiki Kaisha, Tokyo, Japan

[21] Appl. No.: 855,514

[22] Filed: May 13, 1997

[30] Foreign Application Priority Data

May 14, 1996 [JP] Japan ..... 8-119202

[51] Int. Cl.[6] ..... G06F 19/00; B22D 17/32

[52] U.S. Cl. ..... 364/472.02; 164/4.1

[58] Field of Search ..... 364/188, 189, 364/472.01, 472.02, 474.01, 475.02, 475.05, 475.09; 164/4.1, 452, 457, 154.1; 702/84

[56] References Cited

U.S. PATENT DOCUMENTS 4,493,362 1/1985 Moore et al. ..... 164/457

5,022,457 6/1991 Iwamoto et al. ..... 164/155.3

5,222,026 6/1993 Nakamoto ..... 364/472.02

5,455,773 10/1995 Frey ..... 364/472.02

*Primary Examiner*—Paul P. Gordon

*Assistant Examiner*—Steven R. Garland

*Attorney, Agent, or Firm*—Jones & Askew

[57] ABSTRACT

A man-machine interface inputs basic data including die and product data to a casting condition calculating section for calculations to have candidate values computed therefrom by expressions for control items of a casting control process, which values are each received as a candidate value to be set for a corresponding control item by a casting condition setting section, which cooperates with a casting condition setting conformity deciding section for a decision on a conformity of the candidate value to a given condition that can be changed by an operator who can observe a result of the decision on a display and a result of an actual casting.

8 Claims, 5 Drawing Sheets

CASTING CONTROL SUPPORT SYSTEM FOR DIE CASTING MACHINES

BACKGROUND OF THE INVENTION

1. Field of the Invention

The present invention generally relates to a casting control support system for die casting machines, and particularly, it relates to a casting control support system for a casting control process of a die casting machine in which molten metal is injected into dies for casting a product.

2. Description of Relevant Art

For a die casting machine to provide a favorable product, it is necessary for various process control conditions of the casting to be adequately set up, such as of a slow injection speed, a fast injection speed, a fast injection distance, a pressure rise time, a squeeze pressure, a locking force, and a set timing on a die timer (hereafter "die timer value").

Conventionally, such casting control conditions have been each manually set in a trial and error manner by an operator observing a result (a die cast product) of an actual casting, depending on a personal sense based on experiences that have been difficult to digitize.

Such the setting have necessitated a long time and an experienceful skilled person.

SUMMARY OF THE INVENTION

The present invention has been achieved with such points in mind.

It therefore is an object of the present invention to provide a casting control support system for a casting control process of a die casting machine, permitting casting control conditions to be set up in a relatively short time interval without needing a personal sense based on experiences, allowing for a learning by accumulation of voluntarily taught practices and know-hows.

To achieve the object, according to a first aspect of the invention, there is provided a casting control support system (5) for supporting a casting control process (3) of a die casting machine (1) in which molten metal is injected into dies for casting a product, the casting control support system comprising first means (11) for inputting basic data including data on the dies and the product, second means (15, 17) for calculations to have candidate values computed from the basic data for a plurality of control items of the casting control process using a plurality of defined expressions, third means (19, 21, 23) for receiving the computed candidate values each respectively as a candidate value to be set for a corresponding one of the control items and performing a decision on a conformity of the candidate value to a given condition for the corresponding control item, the third means being operative to change the given condition and to output the candidate value as a set value for the corresponding control item, and fourth means (13) for displaying at least one of the basic data, the computed candidate values, the candidate value to be set, the given condition for the corresponding control item, and a result of the decision in a selective manner.

According to the first aspect, a casting control support system for supporting a casting control process of a die casting machine comprises a first means that may be a man-machine interface, a second means that may be a casting condition calculating section provided with a calculation data memory, a third means that may be a combination of a casting condition setting section, a casting condition data memory and a casting condition setting conformity deciding section, and a fourth means that may be a display.

The first means inputs a set of basic data including data on a die assembly and data on a required product.

The second means employs a plurality of expressions that may be changeable or partially modifiable but are defined for a sequence of necessary calculations each time to have a corresponding number of candidate values computed from the basic data for a plurality of concerned control items of the casting control process.

The third means receives a respective one of the computed candidate values as a candidate value to be set for a corresponding one of the control items and performs a decision on a conformity of this candidate value to a given condition for the corresponding control item, permitting an external (manual) operation to change the given condition and to output a conforming candidate value as a set value for the corresponding control item.

The fourth means selectively displays one or more of the basic data, the computed candidates, the corresponding candidate value, the given or changed condition, and a result of the decision, which can be observed by an operator to check a set of associated data and control conditions as well as their conformity before changing a condition for the decision or outputting the set values.

According to the first aspect, therefor, an operator may use a set of conforming candidate values to cast a number of products. The operator may observe the products, and change a given condition to achieve a better casting. As the condition is left changed, another operator may use a set of conforming candidate values to cast a better product.

A personal sense can thus be digitized in due course, allowing for a learning by accumulation According to a second aspect of the invention, as it depends from the first aspect, the data include data on a plurality of selective ones of a thickness, a projected area, a casting weight, a gate sectional area and a biscuit thickness of the dies, a body thickness and a weight of the product, a plunger tip diameter, a filling stroke and a dry shot stroke, and the computed candidate values include values of a plurality of selective ones of a slow approach injection speed, a fast approach injection speed, a fast injection distance, a pressure rise time, a squeeze pressure, a locking force and a die timer value.

According to a third aspect of the invention, as it depends from the first aspect, the defined expressions each include a correction parameter for correcting a corresponding one of the candidate values, and the first means is operative for the second means to change a current value of the correction parameter.

According to the third aspect, each expression for candidate calculation is permitted to have a correction parameter optimized in due course.

According to a fourth aspect of the invention, as it depends from the third aspect, the second means has a memory (17) for storing digital data readable to complement the defined expressions, and the first means is operative to update an arbitrary one of the digital data.

According to the fourth aspect, a second means may have an algorithm of each expression programmed for candidate calculation with an allowance for a complementary term or factor to be specified from time to time by inputting or substituting a digital data, which is stored in a memory. Such the term or factor will be optimized in due course.

According to a fifth aspect of the invention, as it depends from the first aspect, the third means has a memory (19) for storing digital data readable to complement the given condition, and the first means is operative for the third means to update an arbitrary one of the digital data.

According to the fifth aspect, a third means may have an algorithm of each given condition programmed with an allowance for a complementary expression or threshold to be defined from time to time by inputting or substituting a digital data, which is stored in a memory. Such the expression or threshold will be optimized in due course.

According to a sixth aspect of the invention, as it depends from the fifth aspect, the memory is adaptive to store the computed candidate values, and the first means is operative for the third means to read the stored candidate values, using an identifer of the basic data.

According to the sixth aspect, a calculation time can be saved. A set of input basic data or an index thereof may constitute an identifier.

According to a seventh aspect of the invention, as it depends from the sixth aspect, the third means has an automatic mode for outputting the read candidate values as the set values.

According to the seventh aspect, a complete set of casting conditions may be automatically set up for an arbitrary combination of experienced basic data.

According to an eighth aspect of the invention, as it depends from the first aspect, the fourth means is responsible for the result of the decision to provide an alarm, as the candidate value has failed to meet the given condition.

According to the eighth aspect, an output alarm may be effective to avoid entering a casting with non-conforming set values, thus resulting in an increased safety.

BRIEF DESCRIPTION OF THE ACCOMPANYING DRAWINGS

The above and further objects and novel features of the present invention will more fully appear from the following detailed description when the same is read in conjunction with the accompanying drawings, in which.

DETAILED DESCRIPTION OF THE PREFERRED EMBODIMENTS

Figure 1:
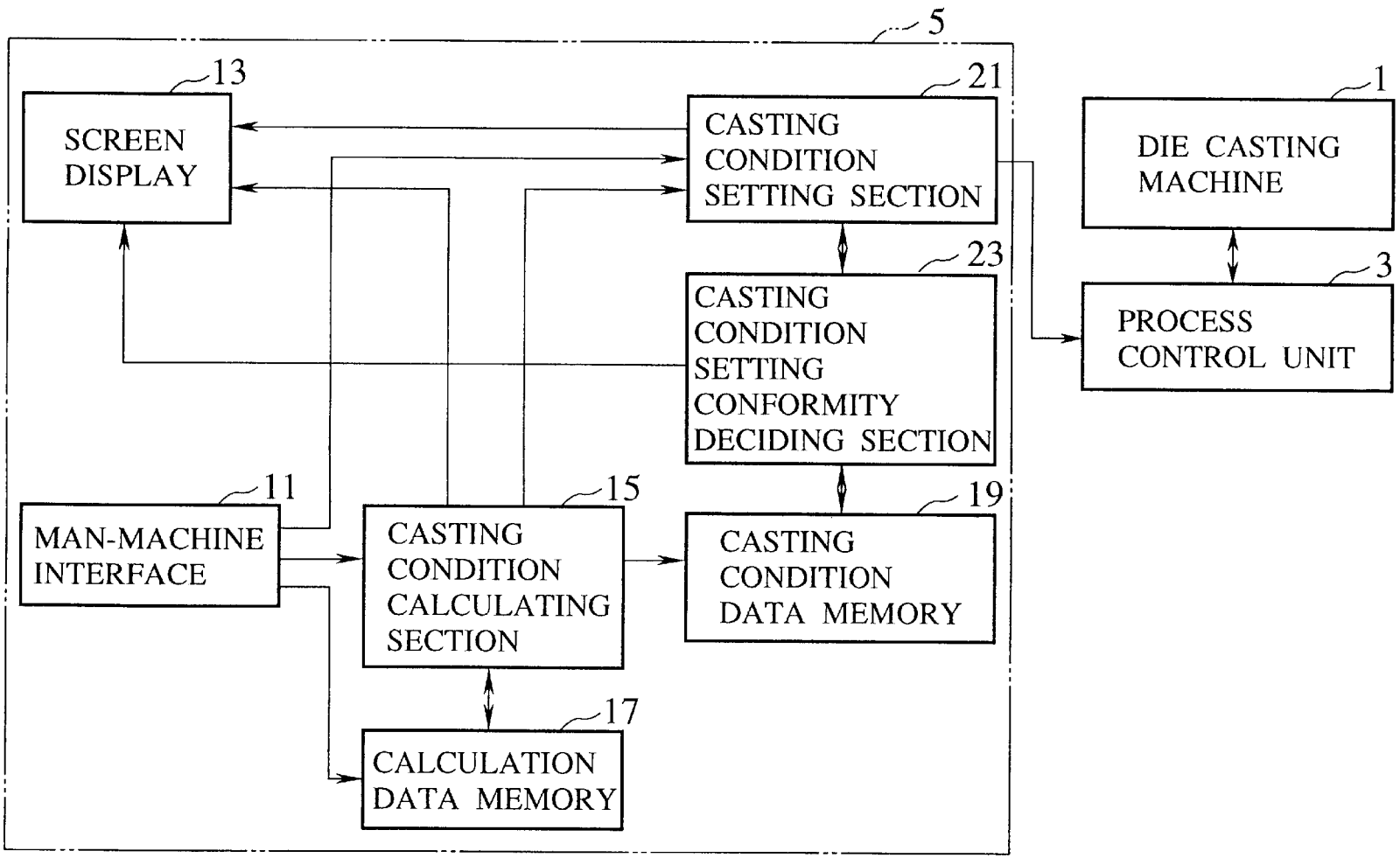
FIG. 1 is a block diagram of a casting control support system for a digital control according to an embodiment of the invention.

It is first noted that U.S. Pat. No. 5,022,457 is incorporated herein by reference for comprehension of a die casting machine having a process control unit of an analog type.

There will be detailed below the preferred embodiments of the present invention with reference to the accompanying drawings: FIGS. 1 to 5. Like members are designated by like reference characters.

Figure 5:
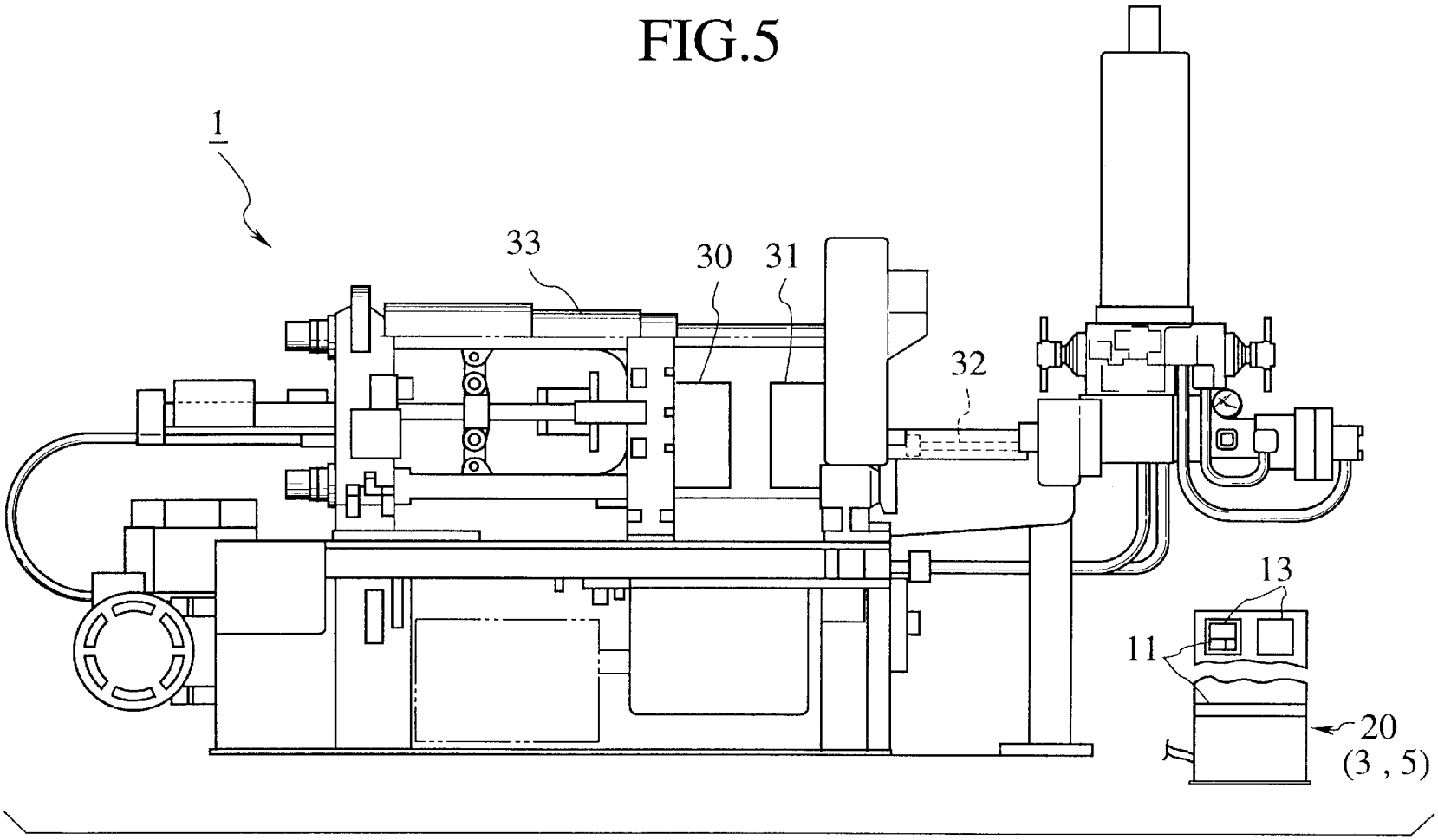
FIG. 5 is an illustration of a die casting machine provided with the casting control support system of FIG. 1.

FIG. 1 shows a casting control support system 5 for supporting a process control unit 3 of a die casting machine 1 according to an embodiment of the invention, and FIG. 5 shows the die casting machine 1.

The process control unit 3 is for controlling a sequence of actions of the die casting machine 1, and may include a program logic controller or the like.

The casting control support system 5 comprises a man-machine interface 11, a screen display 13 that may be a CRT (cathode ray tube) or an LCD (liquid crystal display) such as a touch panel, a casting condition calculating section 15 that may be a program file, a calculation data memory 17 that may include a ROM (read-only memory) and a RAM (random access memory), a casting condition data memory 19 that may comprise blocks of the ROM and the RAM, a casting condition setting section 21 that may be a program file, and a casting condition setting conformity deciding section 23 that may be a program file. The files may cooperate with combinational logics. An entirety of the support system 5 is governed by a CPU (central processing unit) of the process control unit 3. A dedicated CPU may be employed.

The man-machine interface 11 includes a key board arranged on a control panel 20 or a console, and has a data input section for inputting basic data including data of movable and stationary dies 30, 31 and data of a required product, a parameter input section for inputting parameter values such as of correction parameters of later-described expressions for calculations of casting conditions, and a manual input section for directly inputting values to be set for the casting conditions.

The casting condition calculating section 15 performs a sequence of necessary calculations each time to have candidate values computed as casting condition values from the basic data input through the data input section of the man-machine interface 11, using a set of calculation expressions complemented or defined by reading associated data therefor from the calculation data memory 17.

Figure 2:
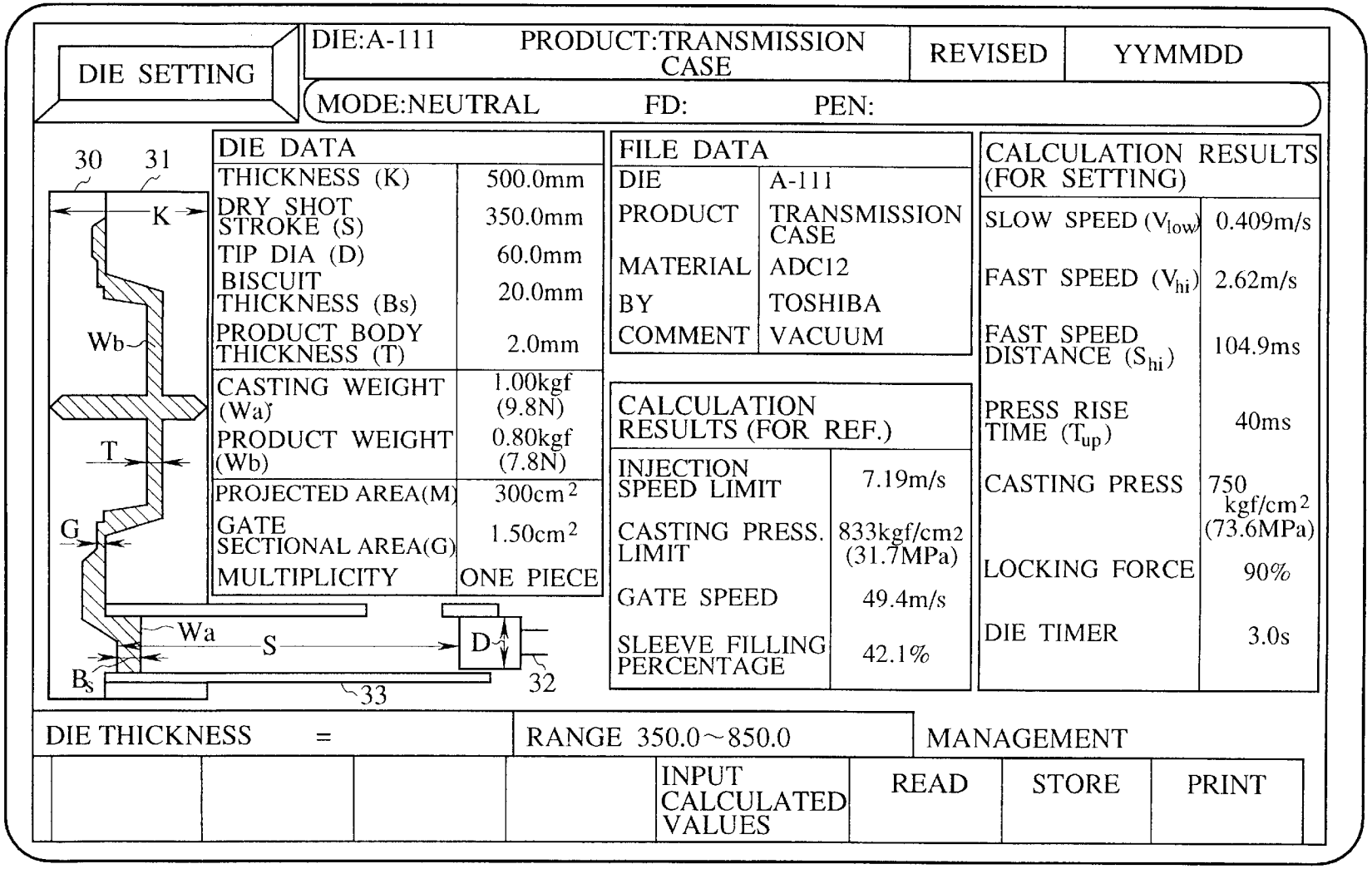
FIG. 2 is an illustrative image of a screen displaying basic data including input die data and product data in a casting condition calculation mode according to an embodiment of the invention.

FIG. 2 shows a display screen in a die setting mode, where it displays basic data substantially on a left side and calculation results substantially on a right side.

The basic data to be input include data on a plurality of selective ones of a thickness, a projected area, a casting weight, a gate sectional area and a biscuit thickness of the dies 30, 31, a body thickness and a weight of the product, a tip diameter of a plunger 32, a filling stroke, a dry shot stroke, etc.

The computed candidate values include values of a plurality of selective ones of a slow approach injection speed, a fast approach injection speed, a fast injection distance, a pressure rise time, a squeeze pressure, a locking force of a clamp unit 33, a die timer value, etc.

In a die data column of the screen of FIG. 2:

THICKNESS means a die thickness in terms of a total thickness of the movable and stationary dies 30, 31, as it is employed for a locking force control;

DRY SHOT STROKE means a dry shot approach distance in terms of a stop position upon completion of a dry shot after the dies 30, 31 are fixed, as it is employed for an injection control;

TIP DIA means the plunger tip diameter to be input for a squeeze pressure control;

BISCUIT THICKNESS means a set value of a biscuit thickness, as it is employable for the injection control such that a shot filling position be the dry shot stroke minus the biscuit thickness;

PRODUCT BODY THICKNESS means an average thickness of a relatively thin portion of the product, as it is employed for a theoretical calculation of casting;

CASTING WEIGHT means a weight of a body of molten metal to be casted, as it is employed for a ladling control such as by computing a measurement angle in dependence on a ladle type and this data;

PRODUCT WEIGHT means a weight of a product with an overflow inclusive, except for a biscuit and a runner, as it is employed for the theoretical calculation;

PROJECTED AREA means a total projection area to a die separation plane, including a biscuit, a runner, a product and an overflow, as it is employed for the theoretical calculation;

GATE SECTIONAL AREA means a sectional area at a position where a runner is in contact with a product part, as it is employed for the theoretical calculation; and MULTIPLICITY means a number of products to be casted by one shot, as it is necessary for a production control.

For calculations of the casting conditions described, there are stored a complete set of defined expressions and complementary parameter data in the calculation data memory 17, such that:

letting $V_{low}$ be the slow approach injection speed, $$V_{low}=\{(6\cdot\sqrt{d})/10^4\}\{4\cdot10^3\cdot Wa/Cc\cdot S\pi D)+36\}K_1,$$

where D is the plunger tip diameter, Wa is the casting weight, Cc is a specific weight coefficient by materials to be casted, S is the dry shot stroke, and $K_1$ is a slow speed correction factor, providing that $$Cc=C\cdot0.9\cdot K_{11}$$

where C is a specific weight of molten metal and $K_{11}$ is a specific weight correction factor, while additional considerations are provided, including a stored expression, to calculate a filling percentage J (%) of a sleeve 33 for reference, such that $$J=(Wa\cdot10^6/C\cdot0.9)(\pi/4)D^2\cdot S\cdot100\cdot K_{12}$$

where $K_{12}$ is a sleeve filling percentage correction factor;

letting $V_{hi}$ be the fast approach injection speed, $$V_{hi}=(S_{hi}/tJ)K_2,$$

where $S_{hi}$ is the fast approach speed distance and $K_2$ is a fast speed correction factor, providing that $$S_{hi}=[(Wb\cdot10^6)/\{Cc(\pi/4)D^2\}]K_3$$

where Wb is the product weight and $K_3$ is a fast speed distance correction factor, and $$tJ=tg=a\cdot K_{13}\cdot T^2$$

where tg is a solidification time of an alloy, $K_{13}$ is a solidification time correction factor, T is the body thickness of the product, and "a" is a solidification coefficient by metallic materials such that Al=11.1, Zn=25.0, Mg=4.9 and Cu=11.4;

letting Tup be the pressure rise time, $$T_{up}=a\cdot K_{13}\cdot T^2\cdot K_4,$$

where $K_4$ is a pressure rise time correction factor;

letting $P_{on}$ be the squeeze pressure, $$P_{on}=(Dz/D)^2\cdot P_{acc}\cdot K_5,$$

where Dz is an intensifier cylinder diameter, $P_{acc}$ is an injection accumulator pressure, and $K_5$ is a squeeze pressure correction factor;

letting F be the locking force in terms of a percent, $$F=(M\cdot P_{acc}\cdot Dz/10\cdot Fc\cdot D^2)K_6,$$

where M is the projected area and Fc is a maximum locking force peculiar to the die casting machine 1; and letting Dt be the die timer value, $$Dt=\{(Bs^2/100)+4\}K_7,$$

where Bs is the biscuit thickness and $K_7$ is a die timer value correction factor.

Besides for the sleeve filling percentage J, various considerations are provided in the form of stored expression to calculate reference values, such that:

$$V\max=\sqrt{\{(Vpc^2\cdot Vpo^2)/(Vpc^2+Vpo^2)}\ ,$$

where Vmax is a limit injection speed, Vpc is a die limit speed, and Vpo is a dry shot limit speed under a current accumulator pressure, providing that $$Vpc=550\cdot\sqrt{[G^2(\pi/4)D^2\cdot P_{acc}/\{(\pi/4)D^2\}^3]}\quad K_9$$

where G is the gate sectional area and $K_9$ is a limit injection speed correction factor, and $$Vpo=\sqrt{(P_{acc}/135)}\ \ Vpo$$

where V'po is a parameter representative of a dry shot maximum speed;

$$Pmax=\{Fc\cdot1000)/M\}K_{10},$$

where Pmax is a limit casting pressure and $K_{10}$ is a limit casting pressure correction factor; and $$\begin{aligned}Vg &= \{(V_{hi}/K_2)(\pi/4)D^2/G\cdot100\}K_8\\ &= (Wb\cdot10^4/a\cdot K_{13}\cdot Cc\cdot G\cdot T^2)K_8,\end{aligned}$$

where Vg is the gate speed and $K_8$ is a gate speed correction factor. Incidentally, as used herein, "limit" means "marginal".

The correction factors $K_1$ to $K_{13}$ can be changed and stored in the calculation data memory 17, by key operations at the man-machine interface 11.

The expressions for the foregoing calculations can also be modifed and stored in the calculation data memory 17, by operations of the man-machine interface 11.

Therefore, know-hows and senses based on experiences of skilled operators can be digitized as stored data for the expressions.

The candidate values computed as casting condition values at the calculating section 15 are transferred by a key operation at the man-machine interface 11 to the casting condition setting section 21, and concurrently are written in the casting condition data memory 19 by a key operation therefor.

The casting condition setting section 21 is operable in a selective one of a manual mode and an automatic mode having a number of selective submodes.

In a submode of the automatic mode, the setting section 21 receives the computed candidate values as values to be set for the casting conditions and outputs them to the process control unit 3, permitting an immediate setting to be performed without relying on a sense of a skilled person.

In another submode of the automatic mode, the setting section 21 reads a complete set of casting condition values from the casting condition data memory 19 to simply output them to the process control unit 3. Casting conditions for a subsequent product may be calculated in advance by the calculating section 15 and stored in the casting condition data memory 19, permitting a time-saved preparation for casting the subsequent product, resulting in an efficient die casting.

A current casting or a trial therefor provides one or more products. An operator checks them for defects or non-conforming points, and changes some of the data stored in the calculation data section 17 with an intention to achieve a better casting. Such a trial and error may be repeated. After a bad casting, the data may be reset to their initial standard values. However, after a good or better casting, the stored data are left as they are. Like this, the expressions described or improved expressions and complementary parameter values such as $K_1$ to $K_{13}$ are progressively brushed up in a learning manner, rendering the computed candidate values the more adequate for casting a good product, permitting a remarkably reduced preparation interval for a conforming casting as well as accumulation of digitized know-hows and senses.

Figure 3:
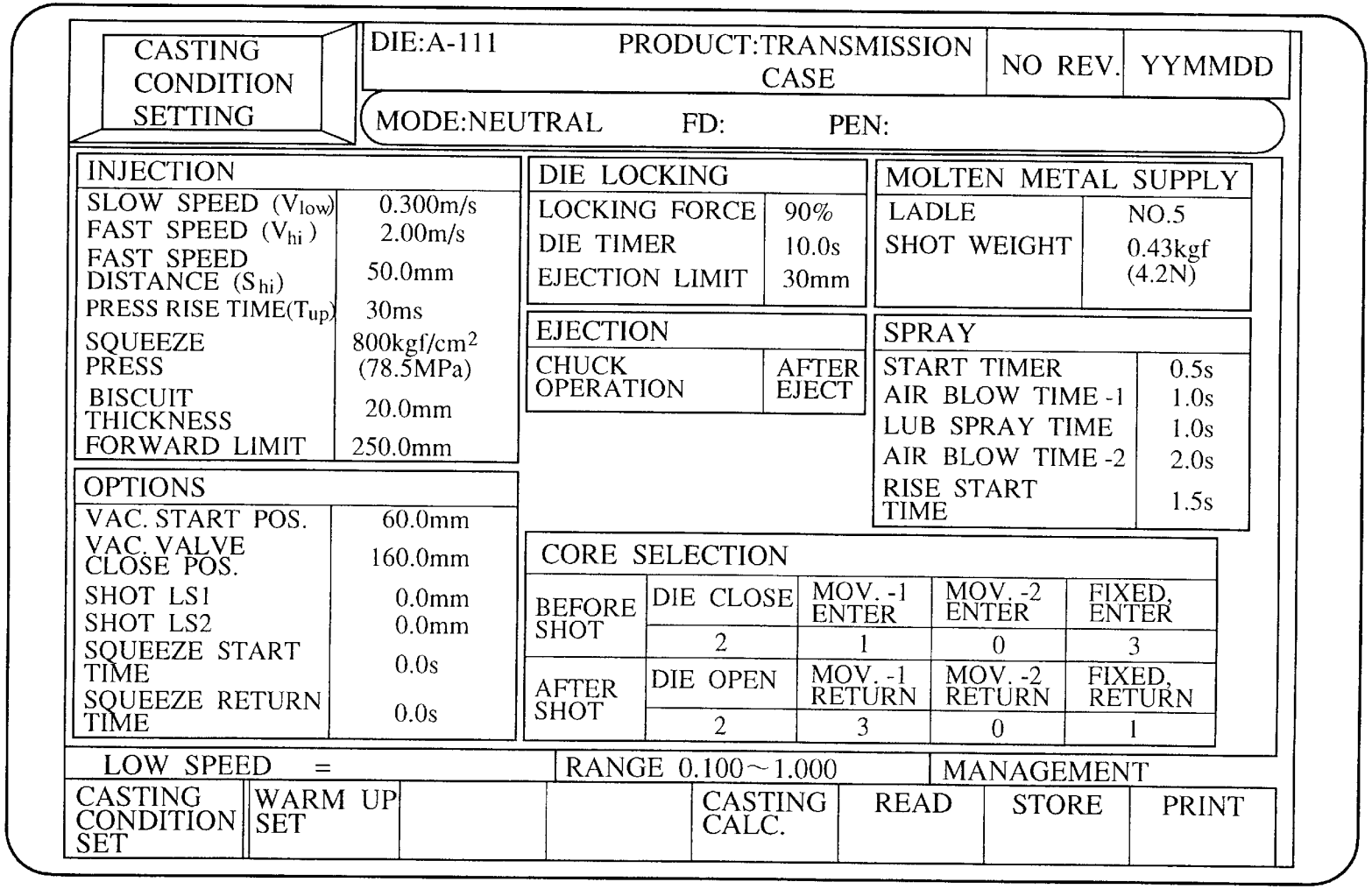
FIG. 3 is an illustrative image of a screen in a casting condition setting mode according to an embodiment of the invention.

FIG. 3 shows a display screen in a casting condition setting mode.

In this display mode, the screen displays either the received candidate values or a set of candidate values read from the casting condition data memory 19 substantially on a left side, and associated process data and conformity criteria on the rest. The process data and conformity criteria are also read from different memory blocks of the data memory 19.

The casting condition setting mode is adaptive to cope with a current casting and prepare for a subsequent. For the latter, an edit screen displays a set of input basic data on an edit region (a memory region), permitting a setting of casting conditions.

In an injection column of the screen of FIG. 3:

SLOW SPEED means a slow approach injection speed which can be automatically corrected;

FAST SPEED means a fast approach injection speed which can be automatically corrected;

FAST SPEED DISTANCE means a fast approach speed distance to be input in terms of a distance for a fast approach injection, which can be automatically corrected;

PRESS RISE TIME means a time interval between from a filling completion to a casting pressure;

CASTING PRESSURE or SQUEEZE PRESSURE represents a pressure per unit area of the product;

BISCUIT THICKNESS is a set value of the biscuit thickness; and

FORWARD LIMIT means a position upon a shot completion after a die-opening follow-up action;

In the manual mode of the casting condition setting section 21, displayed data on the screen as well as conformity criteria can be changed by key operations at the man-machine interface 11 and stored in the data memory 19.

The casting condition setting conformity deciding section 23 makes a decision on a conformity of each candidate value to a corresponding one of the read criteria.

In other words, the conformity deciding section 23 compares the displayed candidate value which may be changed as described, with the corresponding criterion which may be the computed candidate value, as it has been once stored in the casting condition data memory 19 and is read therefrom.

If the former (displayed value) has a difference to the latter (criterion) exceeding a predetermined threshold value, the conformity deciding section 23 outputs an alarm signal to the display 13, where it is displayed in the form of a message or a sound, and to the casting condition setting section 21, where it may be processed to interrupt a setting of the candidate value in concern.

Accordingly, an errorneous or excessive change of the candidate value is always informed to an operator, who can modify the concerned candidate value.

A substantial content of each criterion may comprise an expression to be complemented with a data read from the casting condition data memory 19 for calculating the threshold value.

Such the criterion as well as the threshold value may can be changed by a key operation at the man-machine interface 11, permitting a learning.

Incidentally, the screen of FIG. 2 displays along a left marginal region thereof an illustration covering the dies 30, 31 defining a cavity filled with a body of molten metal, and the plunger 32 with its tip fitted in the sleeve 33. When an arbitrary data or control item displayed on the screen is pressed or accessed in an associated program, a corresponding point or color-identified region on the illustration is highlighted.

Figure 4:
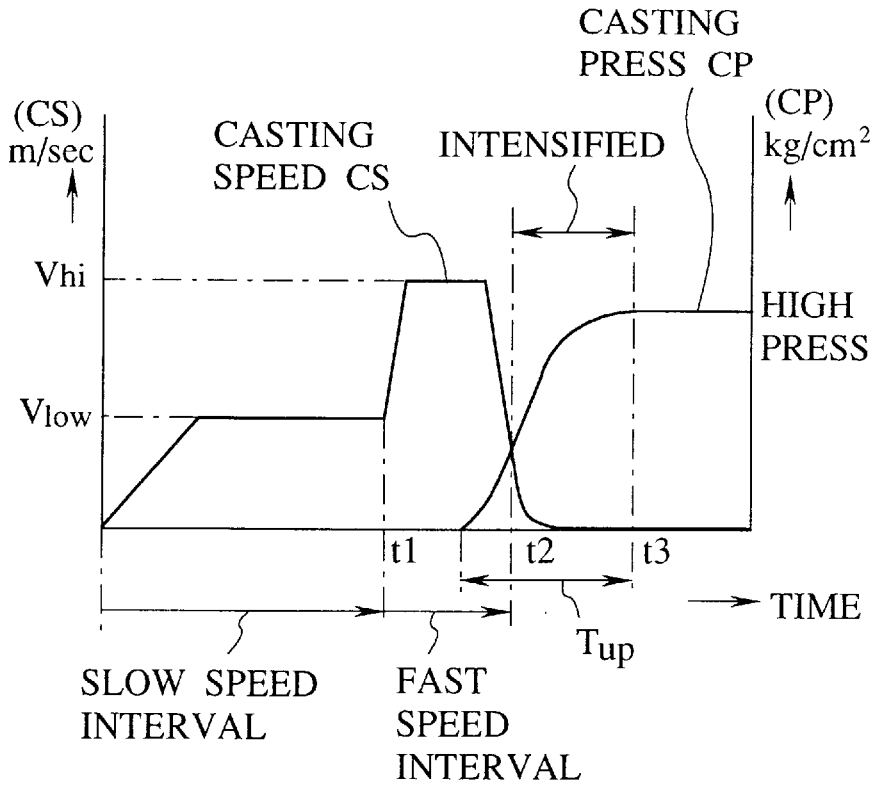
FIG. 4 is an illustrative image of an auxiliary screen for the screens of FIGS. 2 and 3.

FIG. 4 is an illustration of an auxialiry screen displaying a time chart of typical variations of a casting speed CS and a casting pressure CP in the die casting machine 1.

The auxiliary screen can be called up on a right section of the display 11 (FIG. 5), while the screen of FIG. 2 or 3 is displayed on a left display section. The auxiliary screen can display selective one of a number of computed curves and a number of typical curves including the illustrated CS, CP. Along with an operation on the screen of FIG. 2 or 3, a corresponding part of the auxiliary is highlighted.

While preferred embodiments of the present invention have been described using specific terms, such description is for illustrative purposes, and it is to be understood that changes and variations may be made without departing from the spirit or scope of the following claims.

What is claimed is:

1. A casting control support system for supporting a casting control process of a die casting machine in which molten metal is injected into dies for casting a product, the casting control support system comprising:

first means for inputting basic data including data on the dies and the product;

second means for calculations to have candidate values computed from the basic data for a plurality of control items of the casting control process using a plurality of defined expressions;

third means for receiving the computed candidate values each respectively as a candidate value to be set for a corresponding one of the control items and performing a decision on a conformity of the candidate value to a given condition for the corresponding control item, the third means being operative to change the given condition and to output the candidate value as a set value for the corresponding control item; and fourth means for displaying at least one of the basic data, the computed candidate values, the candidate value to be set, the given condition for the corresponding control item, and a result of the decision in a selective manner.

2. A casting control support system according to claim 1, wherein:

the basic data include data on a plurality of selective ones of a thickness, a projected area, a casting weight, a gate sectional area and a biscuit thickness of the dies, a body thickness and a weight of the product, a plunger tip diameter, a filling stroke and a dry shot stroke; and the computed candidate values include values of a plurality of selective ones of a slow approach injection speed, a fast approach injection speed, a fast injection distance, a pressure rise time, a squeeze pressure, a locking force and a die timer value.

3. A casting control support system according to claim 1, wherein:

the defined expressions each include a correction parameter for correcting a corresponding one of the candidate values; and the first means is operative for the second means to change a current value of the correction parameter.

4. A casting control support system according to claim 3, wherein:

the second means has a memory for storing digital data readable to complement the defined expressions; and the first means is operative to update an arbitrary one of the digital data.

5. A casting control support system according to claim 1, wherein:

the third means has a memory for storing digital data readable to complement the given condition; and the first means is operative for the third means to update an arbitrary one of the digital data.

6. A casting control support system according to claim 5, wherein:

the memory is adaptive to store the computed candidate values; and the first means is operative for the third means to read the stored candidate values, using an identifer of the basic data.

7. A casting control support system according to claim 6, wherein:

the third means has an automatic mode for outputting the read candidate values as the set values.

8. A casting control support system according to claim 1, wherein:

the fourth means is responsible for the result of the decision to provide an alarm, as the candidate value has failed to meet the given condition.

* * * * *